United States Patent [19]

Medovar et al.

[11] 4,150,971

[45] Apr. 24, 1979

[54] START-UP METHOD FOR AN ELECTROSLAG REMELTING SYSTEM

[75] Inventors: Boris I. Medovar; Yury V. Latash; Alexsey G. Bogachenko, all of Kiev; Gary P. Kaganovsky, Zaporozhie; Semen A. Leibenzon, Zaporozhie; Konstantin S. Eltsov, Zaporozhie; Georgy K. Gabuev, Zaporozhie; Zinoviy I. Poticha, Zaporozhie, all of U.S.S.R.

[73] Assignee: Institut Elektrosvarki IM.E.O. Patona, Kiev, U.S.S.R.

[21] Appl. No.: 325,386

[22] Filed: Jan. 22, 1973

Related U.S. Application Data

[62] Division of Ser. No. 72,327, Sep. 15, 1970, abandoned.

[51] Int. Cl.[2] ..... H05B 3/60

[52] U.S. Cl. ..... 75/10 R; 13/9 ES; 164/50; 164/52

[58] Field of Search ..... 75/10–12; 164/50, 52, 250, 252; 13/9

[56] References Cited

U.S. PATENT DOCUMENTS

| | | | |
|---|---|---|---|
| 3,234,608 | 2/1966 | Peras | 75/10 |
| 3,273,212 | 9/1966 | Garmy | 75/10 R |
| 3,342,250 | 9/1967 | Treppschuh | 75/10 R |
| 3,376,374 | 4/1968 | Bobo | 13/13 |
| 3,389,208 | 6/1968 | Roberts | 13/9 |
| 3,493,364 | 2/1970 | Nakanishi | 13/9 |
| 3,507,968 | 4/1970 | Parsons | 75/10 R |
| 3,524,006 | 8/1970 | Ebeling | 75/10 R |
| 3,651,238 | 3/1972 | Schlienger | 13/9 |
| 3,670,089 | 6/1972 | Paton | 75/10 R |
| 3,703,600 | 11/1972 | Scott | 13/9 |

FOREIGN PATENT DOCUMENTS

| | | | |
|---|---|---|---|
| 979583 | 1/1965 | United Kingdom | 75/10 |
| 1172041 | 11/1969 | United Kingdom | 75/10 |
| 1173693 | 12/1969 | United Kingdom | 75/11 |

OTHER PUBLICATIONS

"The Electroslag Process," *Metals,* pp. 47–49.

*Primary Examiner*—P. D. Rosenberg
*Attorney, Agent, or Firm*—Strauch, Nolan, Neale, Nies & Kurz

[57] ABSTRACT

A method for start-up and an electroslag remelting furnace system having a bottom pouring device connected to a mold in which at least one electrode is remelted to form an ingot. The bottom pouring device is positioned to receive molten slag and pass it through the lower part of the furnace mold until it rises in the mold and contacts prepositioned current conducting elements in order to complete the electrical power circuit of the furnace. The system includes a slag transfer apparatus which is either located or is shiftable to a location adjacent the bottom pouring device. Pouring of the molten slag is controlled responsive to correlated slag level and contact with the lower end of the electrodes.

16 Claims, 6 Drawing Figures

START-UP METHOD FOR AN ELECTROSLAG REMELTING SYSTEM

CROSS-REFERENCE TO RELATED APPLICATION

This application is a division of application Ser. No. 72,327, filed Sept. 15, 1970 now abandoned.

BACKGROUND OF THE INVENTION

The present invention relates to a method for the start-up of an electroslag remelting furnace system, in particular a system having a bottom pouring device associated with a mold in which at least one consumable electrode is remelted into an ingot, and a slag transfer apparatus which is positionable adjacent to said bottom pouring device and which is operable to control the transfer of molten slag into said device.

In the electroslag remelting of metals, a bath of molten slag is obtained in a remelting zone, for example, a crucible or a mold (often referred to as a crystallizer). At least one consumable electrode is disposed so it depends into the remelting zone with its lowermost end immersed in a molten slag bath. The operating power is electrical, current flowing from the electrode to and through the slag bath which is a resistive conductor. The passage of the current through the molten slag produces heat which causes the electrode to melt. As the end of the electrode melts, its relative position to the mold is shifted to maintain the lower end portion in the molten slag bath until substantially all of the electrode is progressively melted. Because the metal melted from the electrode has a density greater than that of the slag bath, the droplets of molten metal fall through the molten slag and a molten pool of metal is formed below the slag bath. This molten pool of metal progressively solidifies into an ingot of refined metal.

Previously known in the art are various kinds of apparatus for electroslag remelting of metal, using consumable electrodes in a cooled crucible, disposed on a bottom plate and, for carrying out the remelting process, a pool of molten slag is formed in said crucible.

In one previously known system, the molten slag pool is obtained in the furnace crucible by melting of a solid flux or a mixture of its charge constituents during the remelting of a consumable electrode directly in the furnace crucible. In another case, non-consumable electrodes, carbon or graphite, are employed in the furnace crucible for these purposes. In either case this method is known as the "dry start" method.

The previously known art has also employed premelting of flux, or a mixture of its charge constituents, in a separate unit followed by top pouring the molten slag thus obtained into the top open end of the furnace crucible. This method is referred to herein as "top pouring".

In the first two "dry start" cases of preparing the molten slag pool, the time required for obtaining an ingot is increased by as much as 10 to 20 percent over that required with a molten slag start since the melting of slag is carried out directly in the furnace crucible. This of course is likely to decrease the production rate of the plant by as much as 10 to 20 percent.

When preparing the molten slag pool with the use of consumable electrodes, an incomplete melting of the flux can occur in the peripheral zone of the crucible. That condition is likely to drastically impair the surface of the ingot being melted and will increase the bottom discard, to be cropped during the subsequent processing of the ingot, up to 10 percent of the whole ingot.

Although preparation of the molten slag pool in the furnace crucible by top pouring of molten slag is an improvement over the "dry start" methods, and does increase the production rate of the plant and ensures a higher quality of the bottom part of the ingot, the top pouring method has disadvantages. For example, when placing the consumable electrode in the crucible, the gap between electrode and crucible side walls is small, and the pouring of the molten slag presents difficulties. As it is poured from the top, molten slag gets on the crucible walls and on the consumable electrodes and can and does short circuit the system. Short circuits cannot be tolerated so top pouring is done with power turned off. It also can produce slag sows or lumps thereon. The falling off or dropping of the slag sows into the slag pool during the melting process may result in marked variations of electrical conditions of the melting process.

To eliminate those disadvantages in top pouring requires that during the pouring of the molten slag the consumable electrode should be outside the crucible, for which reason the design of the plant must provide sufficient height or head room for lifting the electrode clamped in the electrode holder over the crucible so that the latter can be displaced from under the electrode for pouring the slag therein.

The electric circuit is elongated thereby, the lines cannot be kept short, and consequently, the losses of active energy increase therein, which results in a reduction of the power factor of the plant ($\cos\phi$). In top pouring, after the molten slag is in the crucible, a voltage is applied to the installation, and the consumable electrode is lowered at a maximum speed into the crucible until it is brought into contact with the slag. During the elapsed time, a crust or lining of the solid slag may form on the crucible walls and on the cooled bottom plate or on a dummy bar, if one is placed on the bottom plate, which crust is likely to insulate the molten slag pool from the bottom plate and crucible. An insulating crust results in an open circuit so the melting process may never start. The resultant down time to recondition the furnace for starting is costly not only in lost time but in non-productive labor, and wasted power used to melt the slag.

Disadvantages of the existing plants employed for effecting the electroslag remelting of metal according to the top pouring method, consist in excessive plant height, which is required because of the requirement that pouring of the molten slag is done with the consumable electrode raised. This necessity also results in considerable losses of time required for effecting auxiliary operations. Top pouring is dangerous because the molten slag is raised to a height above the mold for pouring. Besides, dummy bars or sacrificial plates are required for protecting the bottom plate against the burning through which occurs if the consumable electrode is inadvertently lowered too far down through the molten slag and an arc occurs between the electrode and the bottom of the crucible.

A bottom pouring device of the type herein described is disclosed and claimed in U.S. Pat. No. 3,670,089 which is a continuation-in-part of copending applications Ser. No. 592,054, entitled "A Method of Electroslag Remelting of Metal and Plant for Effecting Same" filed Nov. 4, 1966; Ser. No. 10,419 entitled "Method and Apparatus for Electroslag Remelting of Metals"

filed Feb. 11, 1970; Ser. No. 10,485 entitled "Slag Introduction Method for Electroslag Remelting Process" filed Feb. 11, 1970, the latter two, in turn, being continuations-in-part of said application Ser. No. 592,054; and Ser. No. 61,014 entitled "Method of Electroslag Remelting of Metal and Plant for Effecting the Same" filed July 9, 1970 as a divisional of application Ser. No. 592,054, all of the afore-identified applications being now abandoned.

The provision of a bottom pouring device on an electroslag furnace mold provides a critical element for the start-up of the furnace but does not provide an improved operational start-up system by which molten slag may be raised to pouring temperature and then transferred into the bottom pouring device so that the pouring can be controllably discontinued at a predetermined point in the furnace operation. While the provision of the bottom pouring device solves many of the prior art disadvantages and problems as set out above, it does not provide the complete improved start-up system and molten slag handling methodology of this invention.

SUMMARY OF THE INVENTION

The start-up method of the present invention enables molten slag to be raised to the predetermined pouring temperature whereupon it is transferred into the bottom pouring device in a controllable fashion so transferring of the molten slag easily and rapidly can be discontinued upon completion of the furnace electrical power circuit. The system includes two major elements: (1) a bottom pouring device which is connected to the furnace mold and which terminates in an aperture formed through the mold adjacent the lower portion thereof and (2) a slag transfer apparatus which is positionable adjacent to said bottom pouring device and by which molten slag can be poured into the bottom pouring device. The slag transfer apparatus consists of a slag crucible and a slag pouring control operable either manually or automatically to control transfer of molten slag from the slag crucible to the bottom pouring device and into the bottom of the furnace mold.

The slag pouring control includes operable power controls which can be automatically operated in response to the current flow established by the completion of the electrical power circuit through the furnace consumable electrode or it can be operated by a manually actuated switch operated by an operator who is provided with a signal indication of the completion of the electrical power circuit through the electrodes when the bottom poured slag reaches the electrodes.

The slag crucible rests on a base support being pivotally connected thereto and the slag pouring control can be operated to cause the crucible to pivot about the pivotal connection in order to pour the molten slag from a pouring spout into the bottom pouring device. An alternate mode of operation is for the crucible to be fitted with a bottom conduit and a power operated valve for controlling the flow of the molten slag through the conduit which is positioned in a gravity pouring relationship just above the bottom pouring device. When the molten slag reaches the desired level in the furnace mold, the electrical power circuit is completed and remelting proceeds.

In operation the system components permit the handling of slag for the start-up of the electroslag remelting furnace by permitting the molten slag to be raised to the correct pouring temperature which is, for most commercially usable slags, in the range of 1440° C. to 2100° C. and then the transferring of the molten slag into the bottom pouring device and discontinuing of the slag transfer upon completion of the furnace electrical power circuit. Also provided for are the steps of transporting the molten slag to the pouring site which is adjacent the furnace mold in the crucible means itself and the preliminary steps of melting either solid flux to produce the molten slag or heating up of molten slag and the deoxidizing thereof by the addition of oxidizing compounds.

The engineering solutions set forth herein contemplate and provide a start-up system, for the electroslag remelting of metal, which is simple in operation and design. In the start up of electroslag remelting furnaces, it is commonplace to use a high conductivity starter plate such as a copper plate on the crucible base plate for the purpose of obtaining adequate electrical connection. However, considerable difficulty has been experienced with such plates primarily due to the uneven or unequal electrical contact between the overall area of the plate and the crucible base plate. Together with bottom pouring, it is possible to dispose with such a starter plate if the base plate is provided with a recess in which a piece of metal of the same composition as the ingot is fitted. This piece of metal is referred to as a weld lug. When remelting begins in the molten slag bath, the top of the weld lug extending into the bottom of the mold will melt and weld to the ingot. Thus, excellent electrical contacts will be obtained between the base plate and the ingot.

In accordance with another novel embodiment of the present invention, wherein provision is made to pour molten slag into the mold through the bottom portion thereof as described above, an apparatus is provided to enable power to be applied between at least two electrodes which are fed simultaneously as a unit into the mold as the electrodes melt. The power applied between the electrodes causes current to flow between the electrodes through the molten slag, thus heating the slag and melting the electrodes. This technique of energizing the electrodes and supplying heat to the molten slag greatly reduces the inductance losses in the system because the leads supplying power to the system can be and are maintained close together. As a result, the power factor of the furnace is made considerably higher. Because the power factor is higher, much less power is required to produce a given size ingot and a much lower capacity transformer can be used to produce a given size ingot. When a single electrode is used, the application of electrical power between the electrode and bottom plate during pouring results in the liquid slag being electrically connected directly to one side of the power source. In this system embodiment of the present invention, wherein the power is applied between the two electrodes, such a hazard is eliminated.

In another embodiment of the start-up system in accord with the present invention a pair of electrodes can be positioned within the mold from a furnace tower on which they are supported by an electrode holder mounted on a movable carriage. Each of the two electrodes can be connected to the opposite sides of a secondary winding of a transformer in order to supply melting current thereto. The secondary winding of the transformer can be connected through a center tap position thereon to the mold bottom plate in order to provide the furnace with a conductor of equalizing current so that the two electrodes will melt at a uniform rate and maintain the same submerged length in the molten slag bath.

An object of the present invention is to provide a novel start-up method for electroslag remelting enabling a smooth non-arcing electrical start up for electroslag remelting furnace operation. This object is achieved with a system comprising a bottom pouring device connected to the mold of the furnace and a molten slag transfer apparatus which functions to transfer molten slag into the mold through the bottom pouring device. The molten slag transfer apparatus includes a slag pouring control which enables control of transfer of molten slag into the mold through a bottom pouring device to complete the electrical power circuit of the electroslag remelting furnace.

Another object of the present invention is to provide a molten slag handling method for a start-up system which includes apparatus to melt solid flux and then deoxidize the resulting slag, apparatus to raise the slag to pouring temperature, and apparatus to transport the molten slag to a pouring site. Also included are apparatus to transfer the slag to the bottom pouring device and controls operable to discontinue the transfer of slag upon completion of the electrical power circuit to the consumable electrodes.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which.

DESCRIPTION OF THE PREFERRED EMBODIMENTS

Figure 1:
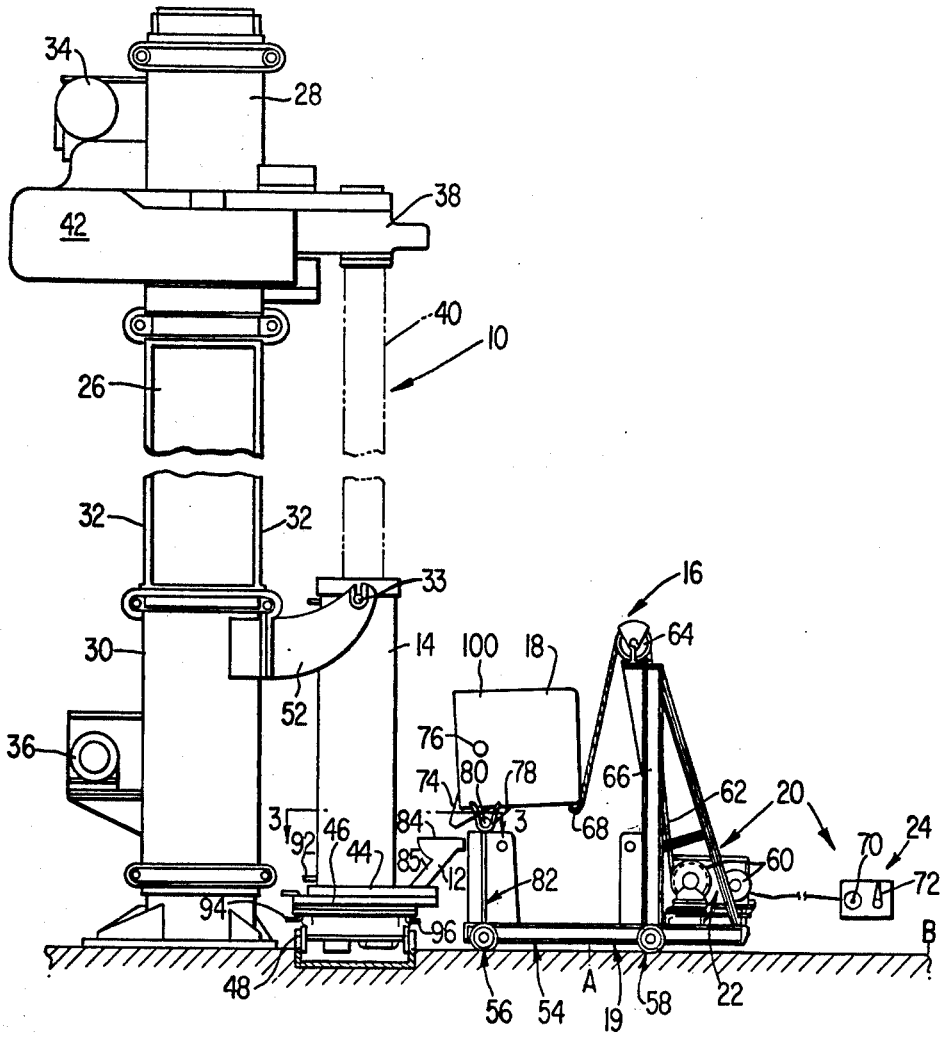
FIG. 1 is a general side elevation view of an electroslag remelting plant incorporating the start-up system for electroslag remelting of metal according to the present invention.

Referring to FIG. 1, the start-up system for an electroslag remelting furnace 10 includes a bottom pouring device 12 connected to the mold 14 of the electroslag remelting furnace 10. A slag transfer apparatus 16 is shown positioned at a pouring site or station location A. The slag transfer apparatus can be mounted on a stationary base or constructed on a dolly (as shown), movable on tracks between position A and a remote position B as shown at which position the slag can be heated to molten state.

Slag transfer apparatus 16 includes a slag crucible 18 and a slag pouring control 20. The slag pouring control, as illustrated, consists of a crucible lifting mechanism 22 and a drive power or current control 24. If desired, other types of crucible lifting mechanism such as hydraulic piston and cylinder motors, rack and pinion arrangements, or direct motor drives can be employed for lifting mechanism 22. As illustrated, the drive power control 24 controls the current input to the lifting mechanism 22 which in turn controls the tilted positioning of crucible 18 between its pouring and nonpouring positions.

The electroslag remelting furnace 10 will be only generally described. It has a support column 26 with vertically shiftable carriages 28 and 30 disposed thereon, the carriages being displaced progressively relative to column 26 along guides 32 by means of drive mechanisms 34 and 36, respectively.

An electrode holder 38 is attached to the upper carriage 28 and provides the structure for securing one or more consumable electrodes 40 (one being shown in phantom lines) to the upper carriage. Electrode holder 38 is the clamp type, the clamps being mounted on upper carriage 28 and operated by a power mechanism 42 which can be a hydraulic operated motor. Thus the electrode 40 can be moved up and down relative to mold 14 as the upper carriage 28 is displaced vertically along tower 26 through the operation of drive means 34.

A bottom plate 44, provided as a detachable part of the furnace mold 14, is supported upon a water cooled dolly 46 fitted with wheel units 48 enabling the mold 14 to be moved along track 50, as desired.

The lower carriage 30 which as aforedescribed is vertically shifted by its drive mechanism 36 has heavy rigid arms 52 extending toward the furnace mold 14 and connecting to the upper portion of the mold at lifting trunnion pins 33. Thus, by shifting the lower carriage upward along its tower, the furnace mold shell or casing can be raised relative to its bottom plate 44.

Figure 2:
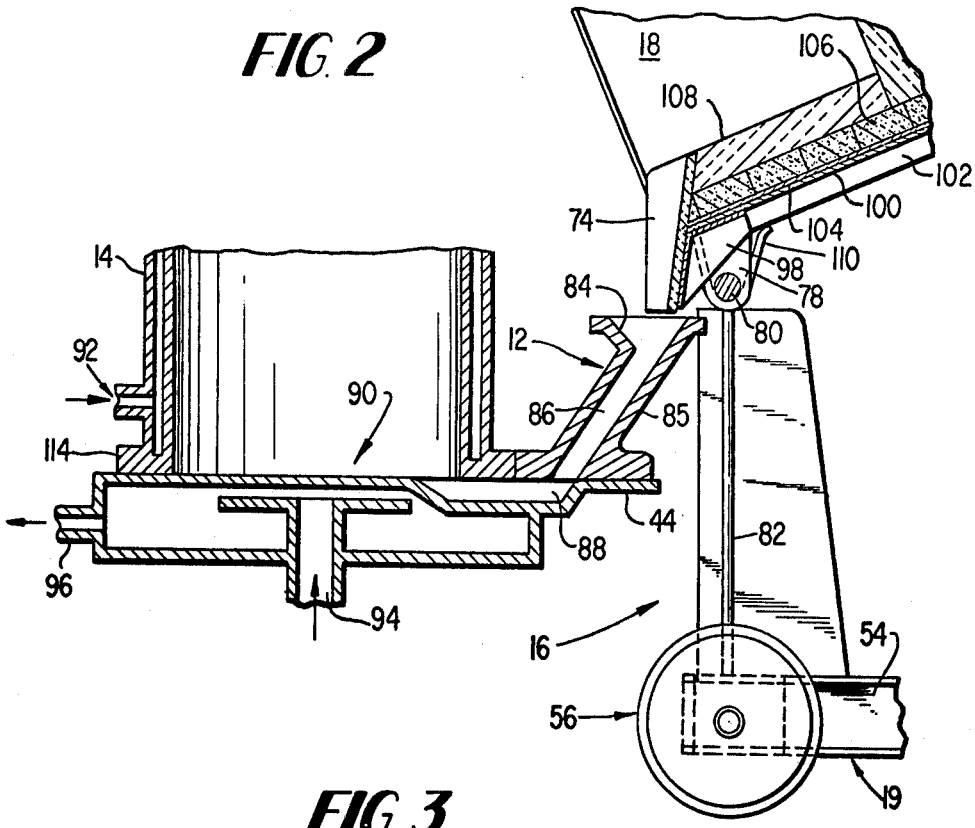
FIG. 2 is an enlarged vertical section detail view of part of FIG. 1 showing structural details of the furnace mold, the bottom pouring device and the slag transfer apparatus including its slag crucible.
Figure 3:
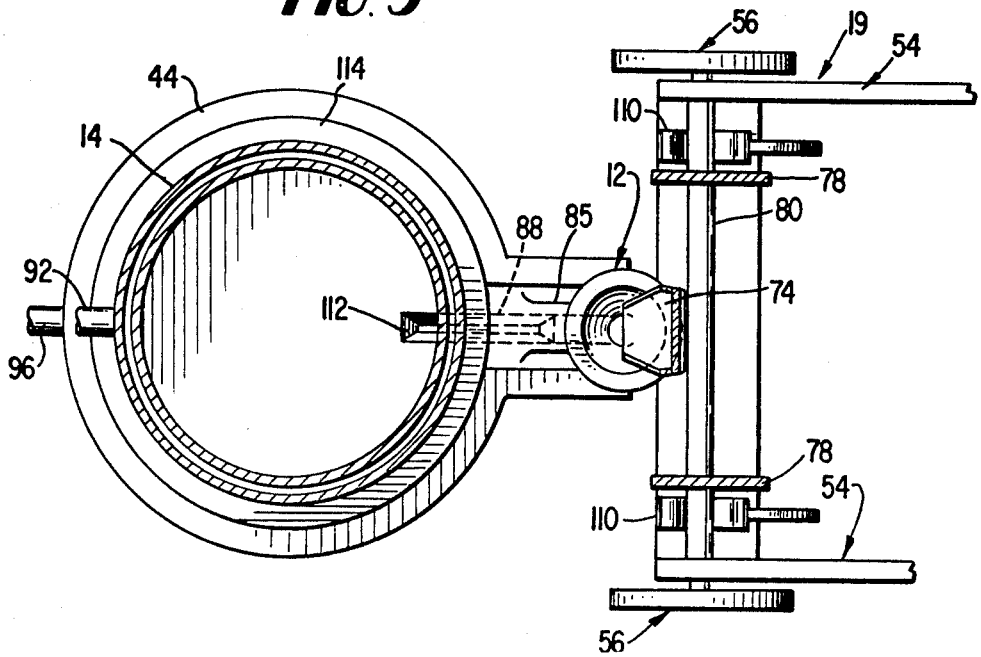
FIG. 3 is an enlarged cross-section view of the system taken along line 3—3 of FIG. 1, showing structural details of the system elements.

The bottom pouring device 12, also seen in detail in FIGS. 2 and 3, is connected to the lower portion of mold 14 through bottom plate 44 and provides a fluid communication conduit or passageway for molten slag which is poured into its hopper shaped upper end and flows through device 12 into the interior bottom portion of mold 14.

SLAG TRANSFER APPARATUS

Referring to FIGS. 1, 2 and 3 details of the slag transfer apparatus 16 are shown. A slag crucible 18 is pivotally supported on a dolly 19. The dolly includes a base 54 which can be constructed of welded steel beams and includes wheels 56 and 58 which can be flanged to permit guided transport of the slag transfer apparatus 16 between positions A and B, as hereinbefore described. The slag pouring control 20 includes an operator mechanism and a power control. The operating or crucible lifting mechanism 22 is mounted on the dolly 19, and includes a reversible electric motor and winch unit 60, a flexible cable 62, a cable idler pulley 64 and a vertical support member 66 constructed of steel beams. Cable 62 has one end wound around and connected to the winch drum and passes up and over the idler pulley 64 rotatably mounted at the top of support column 66. The cable then passes down the rear side and under the bottom of crucible 18 to a location adjacent the front lower edge of the crucible shell where a hook fitting 68 is secured, centered under the forming lip. A ring on the other end of cable 62 is pivotally removably connected to the hook fitting 68.

The motor and winch unit 60 is operated through a power control 24 which can be provided with an amperage meter 70 and a manual motor reversing control switch 72. Power control 24 can be arranged in a portable control panel or such a panel can be mounted on the dolly 19.

Figure 4:
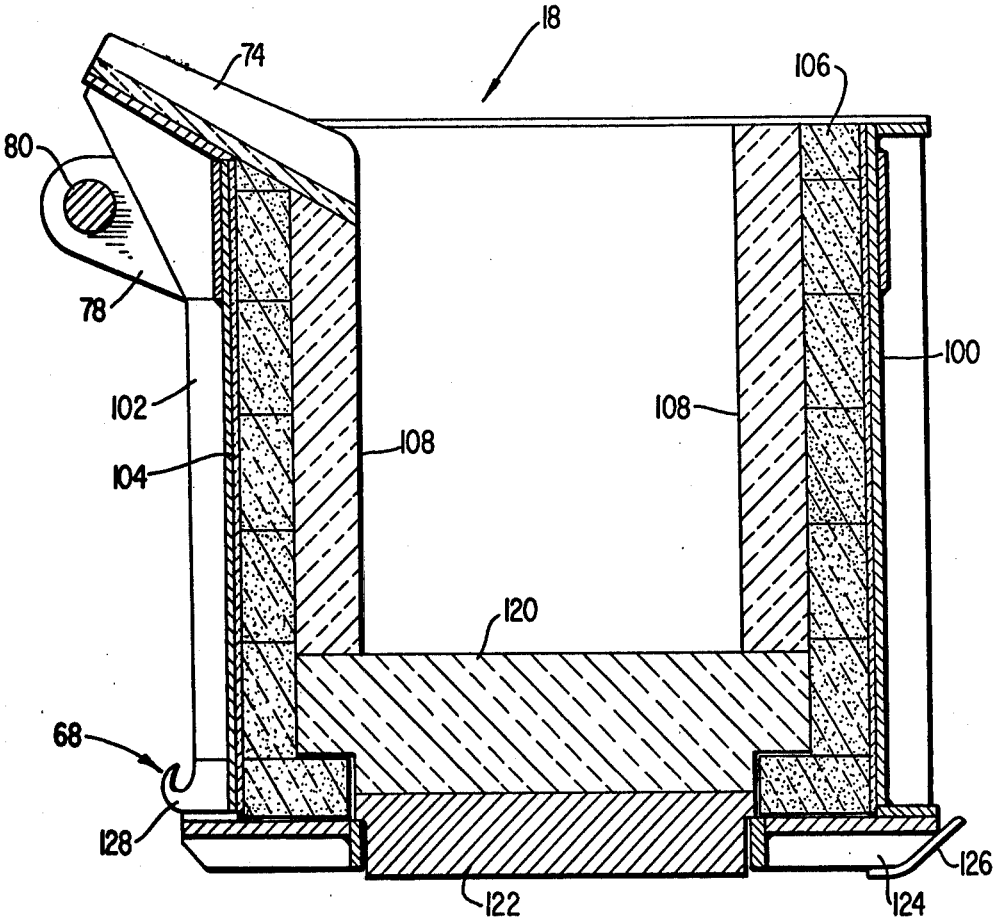
FIG. 4 is an enlarged detail cross-section view of the slag crucible.

Slag crucible 18, as shown in FIG. 1, and in more detail in FIG. 4, is fitted with a pouring spout 74 and symmetrically positioned lifting trunnions 76 used when the slag crucible is lifted by a crane and removed from its dolly. Two spaced apart support pivot arm bracket pieces 78 are fastened on the upper front part of crucible 18 and carry a transverse pivot rod 80 the projected ends of which rest in spaced apart pivot support members 82 extending vertically up from and rigidly secured to the base 50 of dolly 19.

Referring specifically to FIGS. 2 and 3 where several of the start-up system elements are shown in greater detail, the bottom pouring device 12 rests on the furnace mold base plate 44 with its passage 86 in communication with the bottom interior of furnace mold 14. Molten slag poured from the slag crucible 18, via its pouring spout 74, enters the receiving hopper or funnel 84 of the bottom pouring device 12 and immediately flows down the vertically disposed pouring device body 85, within its defined passage 86 and through the horizontal channel or passage 88 in the bottom plate which exits into the electroslag furnace remelting zone 90. At start-up the remelting zone 90 is located in the bottom portion of the furnace mold 14 as defined by the side walls and the bottom plate 44 thereof.

Crucible 18, best shown in FIG. 4, is constructed with a shell 100, which can suitably be made from steel, with welded vertical steel ribs 102 spaced around its exterior for added strength. Several of the vertical ribs, the two spaced apart near the front of the crucible provide rigid support for the two pivot rod brackets 78. Around the inside of shell 100 is a layer of heat resistant material 104 such as asbestos. Within the asbestos lining is a built up wall of fire brick 106, providing a very high temperature insulation layer. Within the layer of fire brick is a graphitized liner 108, conventionally formed as a carbon liner.

Pivot arms 78 carry the pivot rod 80 which, as seen in FIG. 2, rests in the spaced apart U-shaped socket support members 110 affixed to the vertical support members 82 rigidly secured on the dolly base support 54.

Referring to FIG. 3, the relationship of the bifurcated socket members 110 and the slag crucible pivot rod 80 with respect to pouring spout 74 and pivot arm 78 is shown. The pouring spout 74 is illustrated in pouring relationship to the funnel-shaped opening 84 on the bottom pouring device 12. The exit end of the horizontal pouring passage 88 is formed by the linking of the bottom plate 44 with the bottom portion of mold 14 and the base of the bottom pouring device 12. Thus, in the FIG. 3 embodiment, passage 88 has boundaries determined by the top surface of bottom plate 44, a bottom end surface of the sidewall of mold 14, and a bottom surface of the bottom pouring device 12.

To facilitate the removal of slag after the completion of melting, it is desirable that the channel groove provided in bottom plate 44 should have a cross section of trapezoidal or segment-shaped form. This provides for ease of removal of the solidified flux from the channel 88 after completion of remelting.

The channel or passage 88 in the lower portion of the mold can be formed in other ways, i.e., by a radial groove or an aperture (not shown) provided at the lower end of the mold 14. A groove can be covered from below by the bottom plate 44 or mated grooves (not shown) can be provided on facing surfaces of the lower end of the mold 14 and the bottom plate 44. Access into the crucible can be by a single aperture or spaced apart apertures, slightly tapered, (not shown) through one or the other or both of the bottom plate 44 and the side wall of mold 14. All such embodiments of the bottom pouring entry passage or channel 88 will be shaped to provide for a rapid access thereto for cleaning hardened flux from the passages after completion of the melting process. Such suitable shapes are the trapezoidal shapes of the grooves and slight tapers of apertures and bores.

Figure 5:
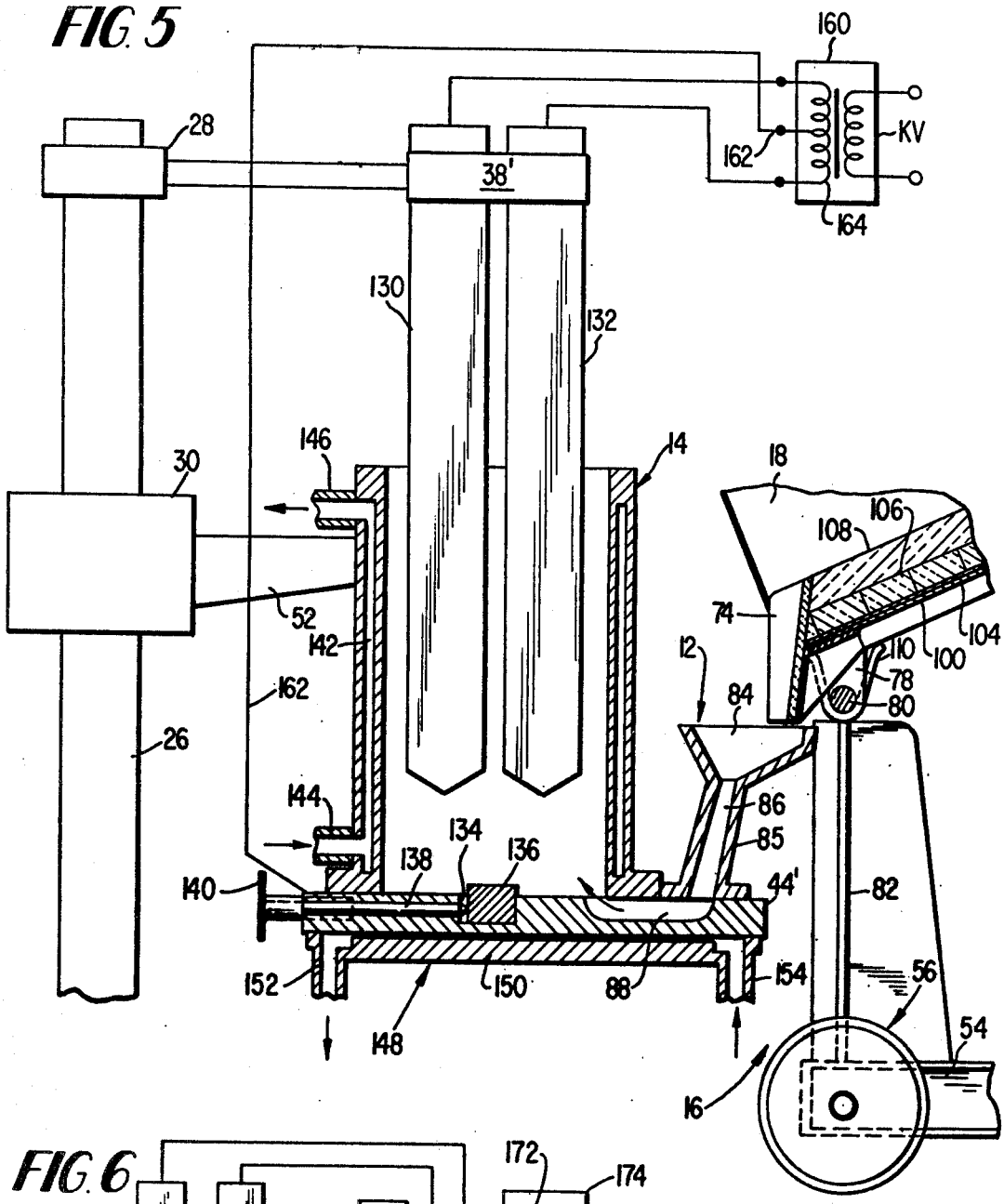
FIG. 5 is a vertical section detail view of a plural electrode modification of the plant shown in FIG. 1.

It is expedient to split the bottom pouring device 12 vertically making it separable along the plane of its channel or passage 86, if the cleaning operation is to be effected immediately after the pouring of the molten slag into mold 14. The bottom pouring device 12 may be made non-detachable, if the cleaning of hardened flux from the channel 86 is effected after the completion of the melting process; in the latter case, however, channel 86 should have a slight taper, for instance, from one to three percent, with the big end down, as shown in FIG. 5.

The topmost end of receiving hopper or funnel 84 ordinarily is located a sufficient distance above the mold bottom plate 44 to insure a head of slag in the bottom pouring device 12 adequate to enable the slag to reach a predetermined depth inside mold 14, whereupon the body of slag will contact the lowermost end of the electroslag furnace consumable electrode 40 (FIG. 1). It is desirable that the lateral end of the pouring device 12 should complement and mate with the shape of the lateral surface of the lower flange 114 of mold 14.

The bottom pouring device 12 may be either fastened to the lower part of the furnace mold, or directly to the bottom plate 44. In other words, when the lower flange of bottom pouring device 12 is provided with a shape which matches the annular flange 114 of mold shell 14, the pouring device 12 can be fastened to the flange 114 or to bottom plate 44 or to both flange 114 and bottom plate 44.

Since the bottom pouring device 12 can be made of metal, part or all of the inside of channel 86, receiving funnel 84 and passage 88 can be lined to resist heat with an appropriate non-metallic liner.

If desired, heating elements (not shown) can be placed on the receiving funnel 84 and/or conduit 85 in order to maintain the temperature of the molten slag as it flows therethrough.

Coolant ports, one shown at 92, are provided in the outer jacket of the furnace mold 14 for supplying coolant (water) to the mold side walls in order to prevent undue heat build-up during the remelting operation. Similar coolant ports 94 and 96, formed in bottom plate 44, provide cooling of the bottom plate.

Apart from the described component members, the system described is also fitted with apparatus and components for supplying a cooling liquid to the furnace mold 14 and its bottom plate 44; liquid cooled electric power cables to the furnace; a system for exhausting gases evolving from the furnace mold during the electroslag melting process; and apparatus for controlling and adjusting the melting operation, aspects which are not described in detail, since they are not material to the essence of the present invention.

START-UP OPERATION

Operation of the start-up system is described with reference to FIGS. 1, 2 and 3. With slag crucible 18 in an upright position, a quantity of solid flux or a quantity of premelted slag is placed in the crucible. This stage of the operation is normally, but not necessarily carried out at a remote location from the furnace, e.g., station B where the nonmolten flux or slag can be heated by a depending nonconsumable electrode.

A preferred manner of the operation of the system is to use a crane or hoist to lift the entire crucible 18, having first detached the flexible cable 62 from its connection 68, from its supporting structure of dolly 19; place the slag crucible on a water cooled base plate connected to the source of electric power, into the slag crucible 18. Lifting trunnions 76 are provided for such an operation or for any moving of the crucible 18 away from and back into position on its support structure or dolly 19, as shown in FIG. 1.

Whichever way the slag is melted, the crucible 18, with molten slag therein, and in place on the slag transfer apparatus 16 with the flexible lifting cable 62 attached to hook connection 68, is then positioned adjacent the bottom pouring device of the ESR furnace. The power control 24 is then operated to drive the motor winch 60 in a direction winding cable 62 around the winch drum, causing slag crucible 18 to pivot about the axis of pivot rod arm 80 and the contained molten slag will pour out over the crucible pouring spout 74 into receiving funnel 84 and thence through passages 86 and 88 into the start-up remelting zone 90 in the lower end of the furnace mold. As it is poured through the bottom pouring device 12, the slag rises in the lower end of the mold and when it reaches a predetermined level, contacts the lowermost end of the depending consumable electrode 40. During bottom pouring, electrical power to the furnace mold is "on" so that when the rising molten slag reaches the electrode and completes a circuit between base plate 44 and electrode 40, current can immediately begin to flow.

Control 24, which controls electrical current to the slag crucible tilting motor, can be operated by an operator positioned a safe distance from the slag transfer apparatus 16. In that event, when the operator is not near the furnace, an indication of initial current flow in the power circuit of the furnace must be made available to the operator. This can be done by means of any indication signal, and one such device is an amperage meter 70 located on the panel with the slag crucible motor current control switch, the meter being connected in the power circuit to the furnace electrode and/or mold.

It is also possible to automatically regulate the slag crucible motor current control 24 using electrical signals received from the power circuit of the furnace so that the initial flow of current in the remelting zone causes automatic termination of the pouring operation by reversing the direction of rotation of the slag crucible tilting motor winch unit 60 to lower the crucible 18 back into its supporting means 54 and 66. Either manual or automatic control may be provided for the start-up system described herein.

SLAG CRUCIBLE

FIG. 4 shows a cross-section view of crucible 18 with enlarged detail. As aforedescribed the crucible has a metal (steel) shell 100, a heat resisting asbestos liner 104, a high temperature insulation fire brick layer 106, and a graphitized liner 108 of cylindrical configuration which rests on a bottom insert 120 constructed of similar or the same material. The graphitized insert 120 is supported by a metallic bottom plate 122 arranged in a supported relationship on an annular steel base member 124. At the rear of the base member 124 is a small curved plate 126 serving as a cable guide to prevent fraying of the cable as it passes under the crucible. The aforedescribed hook 128 is clearly shown at the lower front edge of crucible 18.

A preferred thickness of the asbestos heat resistant liner 104 can be 20 mm.

The slag crucible 18 is designed for use in melting flux directly, and thus can be placed directly in contact with a cooled bottom plate member connected to a source of driving electrical power to heat and melt the flux to molten slag at a separate location B, such as shown in FIG. 1. Alternatively, metallic bottom plate 122 of the crucible itself may be directly connected to the source of electrical heating power and one or more nonconsumable heating electrodes inserted into the upwardly directed open mouth of the crucible, and this can be done while the crucible remains on the slag transferring apparatus 16 shown in FIG. 1.

During operation of the start-up system, the graphite liner accomplishes deoxidizing of the slag. If desired additional deoxidizing compounds can be added to the molten slag while it is being heated within the crucible 18. For example, powdered aluminum is a good deoxidizing material, and when flux is being reused, it can be subjected to regeneration and freed of weak oxides by adding aluminum and calcium fluoride. Addition of such compounds can be accomplished manually or by a mechanically operated hopper or batcher. Appropriate deoxidizing action can be obtained by maintaining the temperature of the molten slag bath for a sufficient time and with the sufficient addition of deoxidizing compounds according to conventional practice.

The deoxidized and properly heated molten slag, having a temperature of between 1440° C. and 2100° C. can then be transferred while still in its crucible 18, via the dolly mounted slag transfer apparatus to the ESR furnace 16 and poured into the furnace mold, through the bottom pouring device 12, as hereinbefore described. The operation provides minimum contact of the molten slag with the air.

MODIFIED START-UP SYSTEM

FIG. 5 shows a modification of the described start-up apparatus wherein two electrodes 130 and 132 are retained in an electrodeholder 38' from which they depend into a mold 14 which, in turn, rests on modified bottom plate 44' similar to that described for FIG. 1. The same vertical carriage 30 can be used to lift the body of mold 14 upward and away from its bottom plate 44' after remelting of electrodes 130 and 132 into an ingot in mold 14 as described for the furnace shown in FIG. 1. During the remelting process, carriage 30 and its rigid support arms 52 provide stationary support for mold 14.

In this instance, bottom plate 44' has a centrally disposed recess 134 in which a cuboid or short cylindrical weld lug 136 is disposed. The weld lug 136 is forced into good electrical surface contact with side wall surface or surfaces of recess 134 by a clamping rod 138 which extends through a lateral passage provided in bottom plate 44 from recess 134 to an outside edge location on the periphery of the bottom plate. An adjustment means 140, schematically illustrated as a hand wheel, is provided at the exterior end of clamping rod 138 for adjusting the clamping force applied to weld lug 136. Material from which the weld lug is made has the same composition as the ingot to be formed by melting of electrodes 130 and 132 under the slag bath.

Mold 14 has an annular coolant channel 142 supplied with a coolant fluid (usually water) through ports 144 and 146 located at the bottom and top of mold 14, respectively. Bottom plate 44' is fitted with a coolant subassembly 148 which consists of a substantially coextensive underplate 150 and side members 152 and 154, shown schematically in cross-section as outside walls of conduits which are releasably connected to bottom plate 44' and underplate 150. The coolant subassembly 148 abutted up against the bottom of bottom plate 44' forms coolant channel 156. A bottom pouring device 12 is shown connected to base plate 44, identical with that hereinbefore described.

Shown at the top of FIG. 5, electrodes 130 and 132 are connected in a series connection to the secondary winding of a single-phase power transformer 160, i.e., one electrode is connected to each end of the secondary winding. The transformer 160 provides the heating source of the remelting furnace when the secondary winding circuit is completed by the slag bath contacting the two electrodes. A conductor of equalizing current 162 is connected from a center tap connection on the transformer secondary winding 164 to the bottom plate 44'. If, for some reason, an equalizing conductor 162 cannot be connected to a center tap of the secondary winding of the single-phase power transformer 160, a circuit arrangement illustrated in FIG. 6, using an equalizing choke 170 can be employed. In such circuit the choke 170 is connected in parallel with secondary winding 172 of transformer 174, and the equalizing conductor 162' is connected to the center tap 176 of the choke winding and to bottom plate 178. The equalizing choke will operate as an auto-transformer having a transformation ratio equal to two.

Using two electrodes in series connection in a transformer secondary, short-term actions of one or a plurality of factors cause an inequality of the linear speeds of melting of the two electrodes, in which case one of the electrodes will become immersed into the slag to a greater depth than the second one. For example, the electrode 132 may become immersed to a greater depth, whereupon the value of the molten slag resistance between the end of this electrode and the bottom plate potential will be decreased as compared with the resistance between the end of electrode 130 and the bottom plate. Operation of the circuits shown in FIGS. 5 and 6 counteracts the above action. Owing to the fact that the resistance path of the longer electrode 132 is shorter than that of the resistance of the second electrode 130, a portion of the current flow through electrode 132, in the disclosed circuits, will by-pass the electrode 130, and flow down to the bottom plate 44' or 178 along conductor 162 or 162' to the center tap connection of the secondary winding of transformer 160 or of the choke 170. Thus, a greater amount of power will be dissipated in the slag at electrode 132 than at the electrode 130, resulting in an increase in heat and the speed of melting of the electrode 132 relative to the speed of melting of electrode 130. The end result is automatic elimination of misalignment discrepancies between desired equal lengths of the electrodes.

The equalizing current conductor 162 or 162' can preferably be formed of a flexible cable having two or more connection lugs at either end portion of a bus bar having openings in the ends thereof for connecting bolts.

Figure 6:
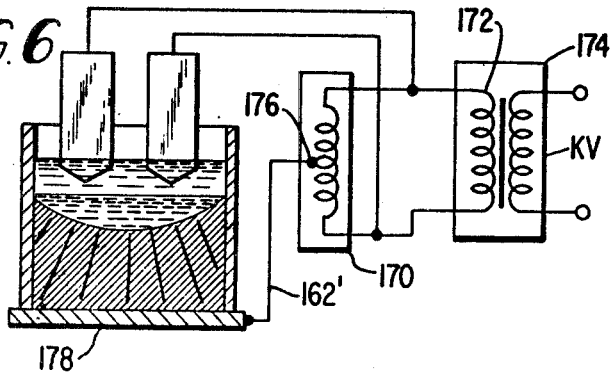
FIG. 6 is a schematic of a modified power circuit which can be used in the plant shown in FIG. 5.

The modification shown and described for FIGS. 5 and 6 can be employed in any of the systems set out in FIGS. 1, 2, 3 and 4, as desired. The weld lug 136 can be used in conjunction with the equalizing current conductor 162 or can be used alone as a power connection to the furnace mold when the melting circuit is completed through the mold itself as in FIG. 1. Similarly, the equalizing current conductor 162 can be used with or without the weld lug 136 and its associated elements. The weld lug 136 provides for continuous good electrical contact between the ingot building up from the remelting of electrodes 130 and 132 and the base plate 44 and the connected conductor 162.

The weld lug of FIG. 5 can be provided for according to the more detailed manner shown in U.S. application Ser. No. 12,601, filed Feb. 19, 1970 entitled "System and Method of Electroslag Remelting of Metals and Alloys", FIGS. 6, 7 and 8. The bottom pouring device 12 described herein can be provided for according to the more detailed manner shown in U.S. Application Ser. No. 10,419, filed Feb. 11, 1970 for a "Method and Apparatus for Electroslag Remelting of Metals", FIGS. 3, 4, 6 and 7. The more detailed weld lug and the bottom pouring devices can be provided in the same manner as shown in FIG. 6 of the latter application.

The pair of electrodes 130 and 132 of FIG. 5 can be a typical arrangement of two square cross-section electrodes in a rectangular mold to form a rectangular ingot as disclosed in Belgian Pat. No. 670,299. As also disclosed in Belgian Pat. No. 670,299, the electrodes employed in the electroslag remelting start-up system described herein can be either of square, rectangular, circular or semi-circular cross-section. The preferred embodiment is to use one pair of electrodes each of square cross-section or one pair of electrodes each of rectangular section to produce an ingot of rectangular or square cross-section and furthermore, it is possible to use two pairs of square or rectangular cross-section electrodes as shown in FIG. 6 of the identified Belgian patent.

With regard to plural pairs of consumable electrodes installed in the plant shown in FIG. 5, it is possible to arrange two pairs of square cross-sectional electrodes in an equally spaced manner in a square cross-section mold and remelt them under a slag bath in order to form a square cross-section ingot. In such a mode of operation each end of the secondary winding of the power supply transformer is directly connected to a pair of electrodes by auxiliary conductors from common terminal points. In the manner above described, the two pairs of electrodes can be mounted onto a single electrode holder to move them simultaneously.

The invention may be embodied in other specific forms without departing from the scope, spirit or essential characteristics thereof. The present embodiments are, therefore, to be considered in all respects as illustrative and not restrictive, the scope and spirit of the invention being indicated by the appended claims rather than by the foregoing description, and all changes which come within the meaning and range of equivalency of the claims are, therefore, intended to be embraced therein.

What is claimed and desired to be secured by Letters Patent is:

1. A slag handling method for the start-up of an electroslag remelting furnace which includes an electric power circuit enabling current to pass through at least one electrode and molten slag within a mold comprising the steps of: raising a body of molten slag to pouring temperature; transferring of the molten slag through a bottom pouring device in fluid communication through the lower portion of the mold of the remelting furnace to a start-up remelting zone within the mold so that the molten slag and the electrode are in electrical contact and the furnace remelting power circuit is completed; and, responsive to a condition indicative of completion of the furnace power circuit upon the molten slag and the electrode making electrical contact, automatically discontinuing said transferring of molten slag.

2. A slag handling method as defined in claim 1, wherein following said temperature raising step, the molten slag is transferred to a pouring site adjacent to the electroslag remelting furnace.

3. A slag handling method as defined in claim 1, wherein preliminary steps comprise melting solid flux to produce the body of molten slag and deoxidizing the molten slag while raising the slag temperature to pouring temperature.

4. A slag handling method as defined in claim 3, wherein deoxidizing is enhanced by raising the slag to pouring temperature in a graphitized slag crucible.

5. A slag handling method as defined in claim 3, wherein deoxidizing is enhanced by addition of deoxidizing compounds to the molten slag preceeding the step of raising the slag temperature to pouring temperature.

6. A slag handling method as defined in claim 5, wherein said deoxidizing compounds include aluminum.

7. A slag handling method as defined in claim 6, wherein said added compounds include calcium fluoride.

8. A slag handling method as defined in claim 1, wherein the slag pouring temperature to which the body of molten slag is raised is from 1440° C. to 2100° C.

9. A slag handling method as defined in claim 1, wherein all of said steps are carried out in apparatus comprising an electroslag remelting furnace start-up system.

10. A slag handling method as defined in claim 1, wherein said step of raising the slag to pouring temperature is accomplished at a location remote from the location of said slag transfer step, and including the additional step of transporting the molten slag at pouring temperature between said two locations.

11. A slag handling method as defined in claim 1, wherein said slag is raised to pouring temperature while located in a crucible on a wheeled transport mechanism.

12. A slag handling method as defined in claim 1, wherein said slag is raised to pouring temperature in a slag crucible having an electrically conductive bottom plate, heating is accomplished by electrical power via a non-consumable electrode inserted into the crucible, and circuit means connect said electrical power to said non-consumable electrode and to the crucible bottom plate.

13. A slag handling method as defined in claim 12, wherein said step of raising the slag to pouring temperature is accomplished at a remote location and said crucible rests on a metal base plate providing a connection into said electrical power circuit.

14. A slag handling method as defined in claim 12, wherein said step of raising the slag to pouring temperature is accomplished at the location of transferring the molten slag to a bottom pouring device.

15. A slag handling method as defined in claim 12, wherein said step of raising the slag to pouring temperature is accomplished while the slag crucible is on a transport device and the electrical power circuit has a direct connection to the crucible bottom plate.

16. A slag handling method as defined in claim 1, wherein the transferring of molten slag to a bottom pouring device is accomplished by controlled means enabling transfer at any rate from zero up to a predetermined pouring rate.

* * * * *